US006413588B1

(12) United States Patent
Pettus et al.

(10) Patent No.: US 6,413,588 B1
(45) Date of Patent: Jul. 2, 2002

(54) METHOD OF PRODUCING DURABLE LAYERED COATINGS

(75) Inventors: William W. Pettus, College Grove, TN (US); Henry Stever Tremper, III, Clayton, NJ (US); Henry A. Tronco, Jr., Springfield, PA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/431,804

(22) Filed: Nov. 1, 1999

Related U.S. Application Data

(60) Provisional application No. 60/115,372, filed on Jan. 11, 1999.

(51) Int. Cl.[7] ..... B05D 1/38

(52) U.S. Cl. ..... 427/327; 427/388.1; 427/409

(58) Field of Search ..... 427/322, 327, 427/409, 412.1, 388.1

(56) References Cited

U.S. PATENT DOCUMENTS

| | | | | | |
|---|---|---|---|---|---|
| 3,617,364 | A | | 11/1971 | Jarema | 117/132 B |
| 4,054,467 | A | | 10/1977 | Mikelsons | 148/6.3 |
| 4,092,448 | A | | 5/1978 | Coll-Palagos | 427/383 D |
| 4,356,233 | A | | 10/1982 | Lange et al. | 428/336 |
| 4,442,269 | A | * | 4/1984 | Sommerfeld et al. | 525/440 |
| 4,476,263 | A | | 10/1984 | Owens | 523/426 |
| 4,742,111 | A | | 5/1988 | Chi | 524/596 |
| 5,001,173 | A | | 3/1991 | Anderson et al. | 523/406 |
| 5,100,732 | A | | 3/1992 | Benefiel | 426/457 |
| 5,190,830 | A | | 3/1993 | Matsuo et al. | 428/626 |
| 5,256,446 | A | | 10/1993 | Bogen | 427/163 |
| 5,357,021 | A | | 10/1994 | Tye et al. | 528/28 |
| 5,578,347 | A | | 11/1996 | Chan | 427/336 |
| 5,605,956 | A | * | 2/1997 | Anton et al. | 524/590 |
| 5,629,372 | A | * | 5/1997 | Anton et al. | 524/507 |
| 5,753,779 | A | | 5/1998 | Verberg | 525/369 |
| 5,789,085 | A | | 8/1998 | Blohowiak et al. | |

FOREIGN PATENT DOCUMENTS

| | | |
|---|---|---|
| EP | 0 525 867 | 2/1993 |
| GB | 2 208 876 | 8/1988 |
| GB | 2 225 737 | 6/1990 |
| GB | 2 283 975 | 5/1995 |
| JP | 63293048 | 11/1988 |
| JP | 02194045 | 7/1990 |
| JP | 03275173 | 12/1991 |
| JP | 06306684 | 11/1994 |
| JP | 06340831 | 12/1994 |
| JP | 09131567 | 5/1997 |

OTHER PUBLICATIONS

Anon, ABC of Painting Technique; Paint Structure and Paint Systems II Substrates,*Fahrz. Metall Lack.*, 36, No. 12, 1992.

Ligner et al., Interactions of radical scavengers (hindered amine light stabilizers, HALS) with automotive clear coats, *Surface Coatings Internat.* (*JOCCA*), 76, No. 6, 233 (4 pp), 1993.

Roland, W. A. et al., Surface preparation of the all–aluminum automobile body before painting, *Metal Fin.*, 91, No. 12, 57–60, 1993.

Charlesworth, T., Next Generation, *Finishing*, 19, No. 2, 38, 1995.

Kummer, J., Surface pretreatment and painting of aluminum bodywork, *Ind.–Lack Betrieb*, 63, No. 10, 348–50, 1995.

Gehmecker, H., Low zinc phosphating, *Metalloberflaeche*, 49, No. 10, 760 (6 pp), 1995.

Bianchi, M., Pretreatment before painting alumimum wheels and radiators, *Verniciatura Industriale*, 29, No. 335, 96–6, 1996.

Courval, G. J., Aluminum finishing system offers cost savings for aluminum intensive vehicle manufacturing, *Metal Fin.*, 94, No. 9, 30–1, 1996.

Van Enckevort, P., Chromium–free pretretment for coil coatings, *O&C* (*Oppervlaktetechnieken*), 40, No. 7, 288–9, 1996.

Anon, Allied Signal buys part of Cabot Corp, *Perfermance Chem. Internat.*, 12, No. 1, 15, 1997.

Hedlund S, et al., Repair painting of motor vehicle materials of steel, galvanised steel and aluminum, Swedish Corrosion Institute, Stockholm, Summary No. 1079 E of KI Report, 2 pp, 1996.

Brocca, G., Clear powder coatings for motor vehicle wheels, *Focus on Powder Coating* (Jan. 1998), 4–5.

Klein W., Ultraviolet Curing in three dimensions, *Metalloberflaeche*, 51, No. 9, 690–1, 1997.

* cited by examiner

*Primary Examiner*—Shrive P. Beck
*Assistant Examiner*—Kirsten A. Crockford
(74) *Attorney, Agent, or Firm*—Sudhir G. Deshmukh

(57) ABSTRACT

The present invention relates to a process for producing a durable multi-layered coating on difficult-to-coat substrates, such as aluminum. The process includes subjecting the surface of the difficult-to-coat substrate to a adhesion promoting step, followed by applying an intermediate layer of flexible primer, which contains a polyester copolymer produced through a two-stage polymerization process. A mar resistant top layer of clear coating composition is then applied over the intermediate layer to produce the multi-layered durable coating on the difficult-to-coat substrate. If desired, the intermediate layer may be pigmented or it may be applied in the form of one or more patterned layers of different colors. Alternatively, one or more patterned layers of different colors may be applied over the intermediate layer before the application of the mar resistant top layer. If desired, the application of the mar resistant top layer and the patterned layers may be delayed by up to 12 weeks to permit the user to mass produce coated components, such as delivery van bodies, with an intermediate layer in a basic color, such as white, which can be then custom coated with various design patterns, followed by the application of the mar resistant top layer.

14 Claims, No Drawings

METHOD OF PRODUCING DURABLE LAYERED COATINGS

The present application claims priority to U.S. Provisional Application Serial No. 60/115,372, filed Jan. 11, 1999.

BACKGROUND OF THE INVENTION

The present invention generally relates to a method of producing layered coatings and more particularly relates to a simplified process that produces layered durable coatings on various difficult-to-coat substrates.

Protective coatings applied over difficult-to-coat substrates, such as aluminum, tend to be less durable than coatings applied over less difficult-to-coat substrates, such as steel, wood, or cement substrates. Difficult-to-coat substrates, generally require extensive surface preparations, such as, by corona discharge, acid etching, or sand blasting, followed by aqueous or solvent cleaning and priming before surface coating of such substrates can be attempted. Furthermore, multi-layered coating systems also generally require surface preparations, such as sanding, before subsequent coats can be applied. Finally, the durability of such coatings on the difficult-to-coat substrates is attenuated when such substrates are exposed to environmental erosion, such as that experienced by auto and truck bodies during normal course of driving conditions.

EP Patent Application 0 525 867 Al (hereafter '867 application) attempts to provide a multilayered coating system suitable for application on various substrates, particularly aluminum substrates. The '867 application involves applying a first coating of an epoxy, alkyd, polyester, polyurethane, polyacrylate or melamine-containing resins, followed by a metallized transparent powder coating layer containing mica-pigment.

However, a need exists for a process with fewer process steps that results in producing durable coatings on difficult-to-coat substrates.

STATEMENT OF THE INVENTION

The present invention is directed to a process for producing a durable coating on a difficult-to-coat substrate, said process comprising:

- subjecting the surface of said difficult-to-coat substrate to an adhesion promoting treatment;
- applying an intermediate layer of a flexible primer on said adhesion promoted surface of said difficult-to-coat substrate, said flexible primer comprising:
  - a polyester copolymer and a crosslinker, said polyester copolymer being produced through a two-stage polymerization process, said polyester copolymer having a linear segment with terminal hydroxyl groups and a GPC number average molecular weight (Mn) in the range of from 500 to 3000, and a branched segment with lateral hydroxyl groups and a GPC number average molecular weight (Mn) in the range of from 750 to 1500;
  - applying a mar resistant top layer of a clear coating composition on said intermediate layer to produce said durable coating on said difficult-to-coat substrate, said clear coating composition comprising:
    - a polyisocyanate binder, fluorinated polyisocyanate binder, an acrylic fluorocarbon binder or a combination thereof.

One of the advantage of the present invention is that it permits user to apply durable coatings on difficult-to-coat substrates with significantly fewer process steps than the steps used in conventional coating processes.

Another advantage of the present invention is that it permits the user to delay the application of the mar resistant top layer for significant time periods without undertaking cumbersome and time consuming sanding and cleaning steps.

DETAILED DESCRIPTION

As defined herein:

"Durable coating" means a coating that does not substantially chip, peel, mar, or delaminate when subjected to humidity and abrasion typically experienced by coating, particularly coatings used on auto and truck components, such as bodies, door panels, cabs, trailer bodies, airplane components, such as fuselage and wings. The chip performance is tested under a modified ASTM D3170-87 Gravelometer Test, described below.

"Clean substrate" means a substrate that has been solvent-washed or soap and water-washed but not physically abraded or chemically treated by a chemical etch, such as chromic acid, or by chemical anodization such as with phosphoric acid or chromic acid. Generally, such a cleaning step may be necessary to remove contaminants, if present, on the surface before it can be coated.

"Aluminum" means aluminum and aluminum alloys.

"Difficult-to-coat substrates" means substrates, such as, aluminum, chrome plated steel, stainless steel substrates or substrates from certain resins, such as, polyamides, polyetherimides and polyacetals.

The process of the present invention is suited for producing durable protective coatings on the difficult-to-coat substrates. The process of the present invention is particularly suited for aluminum and polyamides and more particularly suited for aluminum. However, if desired, it could be readily used for coating the less difficult-to-coat substrates.

Furthermore, the durable coatings produced by the process of present invention, in addition to being protective, can also be decorative.

It has been found that mechanical abrasion of a substrate surface is generally necessary in conventional processes to improve initial and long term adhesion of any subsequent coating on the underlying substrate surface. By mechanical abrasion is meant the use of sand paper, grit- or shot-blasting. By contrast, in the process of the present invention, it is generally not necessary to mechanically abrade the substrate surface followed by priming of the surface to improve the adhesion of subsequent coatings thereon. As a result, significant number of surface preparation steps are eliminated in the process of the present invention and a significant cost savings are achieved as a result thereof. Furthermore, as no mechanical abrasion of the surface is necessary, the structural strength of the underlying substrate is not compromised, especially when thin substrates are coated.

Unless the surface of the substrate is clean, it is desirable to remove any surface contaminants, such as dirt, airborne contaminants, oily, waxy or greasy substances from the surface, before the application of durable coatings by the process of the present invention.

In the cleaning step, in order to be sure that there is no wax, grease, silicone, dust, or other contaminants, a wax and grease remover, solvent, acid, or base wash, or soap/water can be used to clean the surface. Durable coatings do not adhere properly to a waxy surface. Depending on the size of the substrate, its surface may be immersed or wiped with a clean, dry cloth or paper towel soaked in a conventional wax and grease remover, such as 3812 S Fast-Dry Reducer or 3832 S reducer, both supplied by DuPont Company, Wilmington, Delaware. One such remover solvent includes 80 to 95 percent by weight of an aqueous medium and 5 to 20 percent by weight of an organic medium, substantially miscible with the aqueous medium. The organic medium preferably includes:

1.10 to 50 percent of an alkyl ester;

2.40 to 85 percent of a glycol ether selected from propoxy alkanol and ethoxy alkanol; and 3.2.5 to 10 percent of a conventional non-ionic surfactant. All weights being based on the total weight of the solvent.

After the foregoing cleaning step, the cleaned substrate surface is subjected to an adhesion promoting treatment to improve the adhesion of the difficult-to-coat substrate surface to the subsequent coatings thereon. Chemical treatment, such as chromic acid anodizing and phosphoric acid anodizing may be used. However, the preferred adhesion promoting treatment is described in U.S. Pat. No. 5,578,347, which is incorporated herein by reference. Such a preferred method provides for applying a thin, substantially uniform film of an adhesion promoter described below. By "thin" is meant a layer on the order of a monolayer or an amount not significantly in excess thereof, e.g., having a dry thickness less than 2,540 ANGSTROM (Å) (0.1 mil), preferably in the range of from 100 Å to 2,500 Å. The necessary thinness of the silane coating is assured by removal of excess of the adhesion promoter. This is typically accomplished by finishing with water or aqleous-organic solvent, wiping with a water-wet material or blowing with air. Residual water is removed by drying (forced or natural) prior to application of the primer and/or topcoat.

The silane adhesion promoter suitable for use in the present invention includes a solution of one or more silanes having the following formula:

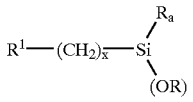

wherein x is 1, 2 or 3, R is the same or different alkyl having in the range of from 1 to 3 carbon atoms, a is 0, 1, 2 or 3, b equals 3-a, and $R^1$ is selected from the group consisting of:

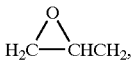

$H_2N$, $H_2N(CH_2)_2NH$, $H_2N(CH_2)_2NH(CH_2)_2NH$, and $H_2N[(CH_2)_2NH]_z$ wherein z is 0, 1, 2 or 3, said silane being present in a concentration in the range of 0.001 to 10.0 percent, preferably in the range of 0.5 to 7.0, more preferably in the range of 1.5 to 3.5, all weight percentages being based on the total weight of the solution. The preferred species of silanes include α-glycidoxypropyl-trimethoxy-silane and γ-aminopropyltriethoxy silane. Additional preferred species of silanes are disclosed in U.S. Pat. No. 5,578,347, which are incorporated herein by reference. The foregoing silane adhesion promoter is supplied by DuPont Company, Wilmington, Del. under the trade mark METLOK® 230S Adhesion System.

Upon completion of the foregoing step, an intermediate layer of a flexible primer is conventionally applied over the adhesion promoted surface of the difficult-to-coat substrate. The flexible primer suitable for use in the present invention includes a polyester copolymer and a suitable crosslinker. The polyester copolymer is produced through a two-stage polymerization process and it has a linear segment having a GPC number average molecular weight (Mn) in the range of from 500 to 3000 with terminal hydroxyl groups, and a branched segment having a GPC number average molecular weight (Mn) in the range of from 750 to 1500 with lateral hydroxyl groups.

In the first stage of the process, one half of the carboxyl groups of a diacid or a diacid anhydride are reacted in approximately stoichiometric proportions with one of (A) one half of the hydroxyl groups of the linear segment and (B) 10 to 80% of the hydroxyl groups of the branched segment to form a first reaction product, and then, in the second stage of the process, the other half of the carboxyl groups of the first reaction product are reacted in approximately stoichiometric proportions with the hydroxyl group of the other of (A) and (B).

Preferably, after the first stage but before the second stage of polymerization the branched segment has a number average molecular weight of 750 to 1000, a hydroxyl number of 175 to 300, an acid number of 20 to 60 if the carboxyl group has been reacted first with the branched segment or less than 5 if the carboxyl group has been reacted first with the linear segment, and a number average functionality of 2.5 to 11; and the linear segment has a number average molecular weight of 500 to 3000, a hydroxyl number of 15 to 300, an acid number of less than 5 or 20 to 60, respectively, and a number average functionality of 1.1 to 2.

The first stage reaction is preferably conducted at at least 100° C., more preferably at at least 150° C. The second stage reaction is preferably conducted at at least 200° C.

The linear segments preferably result from using one or more of the following monomers:

Neopentyl glycol, 1,6-hexanediol, Esterdiol-204®, a commercial diol produced by Union Carbide Company, o-phthalic anhydride, isophthalic acid, adipic acid, and azelaic acid.

The branched segments preferably result from using one or more of the following monomers:

Neopentyl glycol, 1,6-hexanediol, trimethylolpropane, o-phthalic anhydride, isophthalic acid, 1,12 dodecanoic diacid, adipic acid, and azelaic acid.

The linear and branched segments are preferably linked together through one or more of the following capping agents:

O-phthalic anhydride, succinic anhydride, and glutaric anhydride.

If desired, the flexible primer may contain conventional pigment, such as a white or colored pigment to improve hiding and also for aesthetic reasons.

The suitable crosslinkers include conventional crosslinkers, such as melamine/formaldehyde resins, polyisocyanate resins and urea formaldehyde resins, all typically used in the ratio of 10 percent to 50 percent by weight based on the total weight of the flexible primer.

Additional information on the foregoing flexible primer are provided in U.S. Pat. No. 4,442,269, which is incorporated herein by reference.

Upon completion of the foregoing step, a mar resistant top layer of a clear coating composition is applied over the intermediate layer to produce a durable coating on the difficult-to-coat substrate. If desired, the application of the mar resistant top layer over the intermediate layer may be delayed by up to 1 week to 12 weeks, thus permitting the user to mass produce articles having a standardized base coat, such as a white pigmented coat. If the application of the mar resistant top layer is delayed, the intermediate layer is preferably rinse cleaned with conventional detergents, such as soap, to remove any dirt or grease that may have accumulated on it, before the application of the mar resistant top layer on the intermediate layer. By contrast, conventional primers generally require sanding of the coated surface, if further coating applications are delayed typically by more than 36 hours. However, in the process of the present invention, applicants have unexpectedly discovered that, unlike conventional primers, the intermediate layer of the present invention does not require any such sanding step before it is subjected to additional coating application, even after a delay of up to 12 weeks.

The clear coating composition suitable for use in the present invention includes a polyisocyanate binder, fluorinated polyisocyanate binder, an acrylic fluorocarbon binder or a combination thereof. Any conventional clear polyisocyanate binder is suitable for use in the process present invention. The fluorinated polyisocyanate binder, an acrylic fluorocarbon binder or a combination thereof is preferred, since it is easy to remove undesired markings, such as graffiti, by conventional cleaning means, such as detergents, on the top layers from these binders. Preferably, the clear coating composition includes conventional UV screeners, such as Tinuvin 900® UV Absorber or UV light-stabilizers, such as Tinuvin 901® Hindered amine, supplied by Ciba Specialties of New Milford, Connecticut, to prevent UV degradation of the mar resistant top layer.

The clear coating composition containing the fluorinated polyisocyanate binder includes the fluorinated polyisocyanate, which is a reaction product of an organic polyisocyanate and a fluorinated monofunctional alcohol represented by the formula:

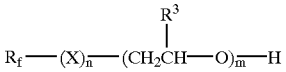

where $R_f$ is a fluoroalkyl containing group having at least 4 carbon atoms, X is a divalent radical, $R^3$ is H or an alkyl group having in the range of from 1 to 4 carbon atoms, n is 0 or 1 and m is in the range of from 0 to 30 provided that when n is 0 then m must be equal to or greater than 1 and when m is 0 then n is 1; wherein in the range of from 0.1 to 33 mole percent of active isocyanate groups are reacted with the fluorinated monofunctional alcohol; and a film forming polymer, such as an acrylic polymer, a polyester, an alkyd resin, a polyol or a combination thereof.

The fluorinated polyisocyanate is an adduct of a fluorinated monofunctional alcohol and a conventional organic polyisocyanate. Any of the conventional aromatic, aliphatic, cycloaliphatic di- and trifunctional polyisocyanates can be used. Typically useful diisocyanates are 1,6-hexamethylene diisocyanate, isophorone diisocyanate, 4,4'-biphenylene diisocyanate, toluene diisocyanate, bis cyclohexyl diisocyanate, tetramethylene xylene diisocyanate, ethyl ethylene diisocyanate, 2,3-dimethyl ethylene diisocyanate, 1-methyltrimethylene diisocyanate, 1,3-cyclopentylene diisocyanate, 1,4-cyclohexylene diisocyanate, 1,3-phenylene diisocyanate, 1,5-naphthalene diisocyanate, bis-(4-isocyanatocyclohexyl)-methane, and 4,4'-diisocyanatodiphenyl ether.

Typical fluorinated monofunctional alcohols used to form the isocyanate functional adducts are represented by the following formula:

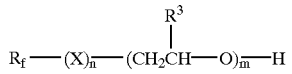

where $R_f$ is as defined above, a fluoroalkyl containing group having at least 4 carbon atoms and preferably a straight chain or branched chain fluoroalkyl group having 4 to 20 carbon atoms which optionally can contain oxygen atoms as ether groups or can contain 1 to 5 chlorine atoms or 1 to 5 hydrogen atoms. Preferably, $R_f$ is a perfluoroalkyl group having 4 to 20 carbon atoms and most preferably, $R_f$ is a perfluoroalkyl group containing 6 to 12 carbon atoms. X is a divalent radical, preferably —$CH_2CH_2O$—, —$SO_2N(R^4)CH_2CH_2O$—, —$CH_2$—, —O—, —$CH_2O$— where $R^4$ is an alkyl group preferably having 1–4 carbon atoms. $R^3$ is H or an alkyl group having 1 to 4 carbon atoms, H and methyl being preferred, n is 0 or 1 and m is 0 to 30, provided that if n is 0, then m must be greater than or equal to 1, if m is 0, then n is 1, if X is —O—, m must be greater than or equal to 1; m preferably is 1 to 20.

The fluorinated organic polyisocyanate is prepared by conventional techniques in which the fluorinated monofunctional alcohol and organic polyisocyanate are charged into a reaction vessel optionally with solvents and a catalyst for about 0.1 to 4 hours and heated to about 50 to 120° C. preferably, 60 to 85° C.

The aforedescribed fluorinated polyisocyanate binder is described in the U.S. Pat. No. 5,605,956, which is incorporated herein by reference.

The clear coating composition containing the acrylic fluorocarbon binder includes an acrylic polymer and an organic polyisocyanate crosslinking agent. The acrylic polymer is polymerized from a monomer mix comprising one or more hydroxyl containing monomers and one or more fluoroalkyl containing monomers represented by the formula:

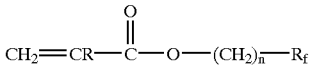

where R is hydrogen or an alkyl group having 1 or 2 carbon atoms, n is an integer in the range of from of 1 to 11 and $R_f$ is a fluoroalkyl containing group having at least 4 carbon atoms, said acrylic polymer having a weight average molecular weight in the range of from 2,000 to 20,000. The further details of the $R_f$ are same as those described earlier.

The top layer of the foregoing, in its cured state has a combination of a water advancing contact angle of at least 100° and a hexadecane advancing contact angle of at least 40° C.

The acrylic polymer is polymerized from hydroxyl monomers containing 20 to 45% by weight, based on the weight of the acrylic polymer, of polymerized hydroxyl containing monomers selected from the following group of hydroxy alkyl acrylate or methacrylates having 1 to 4 carbon atoms in the alkyl group, about 50 to 79.9% by weight, based on the weight of the acrylic polymer, of polymerized alkyl acrylates and methacrylates having 1 to 18 carbon atoms in the alkyl groups, or styrene or any mixtures of the above. To the foregoing acrylic polymer polymerized from hydroxyl monomers, 0.1 to 5.0% by weight, based on the weight of the acrylic polymer, of the fluoroalkyl containing monomer is added.

The aforedescribed acrylic fluorocarbon binder is described in U.S. Pat. No. 5,629,372, which is incorporated herein by reference.

The clear coating composition of the present invention and the flexible primer may also contain conventional additives, such as, pigments, stabilizers, rheology control agents, flow agents, toughening agents and fillers. The addition of such additives will, of course, depend on the intended use of the coating composition. Thus, fillers, pigments, and other additives that would adversely effect the clarity of the cured coating will not be included if the composition is intended as a clear coating.

Furthermore, if desired, it is contemplated that the intermediate layer may be applied in the form of one or more patterned layers, each of the patterned layer containing one or more pigments of different colors. Thus, the design of the pattern layer or layers may be applied in the form of an advertisement or a commercial message, such as those typically applied over the body of a delivery truck or van.

Alternatively, the patterned layer or layers may be applied on top of an intermediate layer, preferably of a solid single color. It is further contemplated that the patterned layers may comprise conventional pigmented paints or it may be in the form of a self-adhesive decal. The mar resistant layer is then applied over the patterned layers. If desired, the patterned layer or layers may be applied after a delay of 1 week to 12 weeks along with the mar resistant layer. As a result, the user is permitted to mass produce coated articles, such as delivery van bodies, having an intermediate layer of standardized color, such as white; store or ship the coated articles over a period of weeks to customers who can then apply their design patterns and the top mar resistant layer on the articles, without the cumbersome sanding and cleaning steps.

The foregoing process is also suitable for applying durable coatings on difficult-to-coat resin substrates, such as those made from Nylon®-6 and Nylon®-6,6 polyamides, Kevlar® aromatic amide, all supplied by DuPont Company of Wilmington, Del., and Ultem® polyetherimide and Delrin® polyacetal, both supplied by General Electric Company of Fairfield, Conn.

The foregoing invention is most suitable for producing durable mar resistant multi-colored, multi-layered coatings on automotive bodies or frames, made of difficult-to-coat substrates, such as aluminum. These aluminum bodies or frames are typically used in commercial vehicles, such as those used in transporting beverage bottles. The process is also well suited for coating aluminum cans and aircraft bodies.

TEST PROCEDURES

Durability

Panels of difficult-to-coat substrate (untreated field aluminum) coated with durable multi-layered coating were tested using ASTM D3170-87 Chip Resistance Test (Gravelometer Test) for their durability under harsh environments. The Gravelometer Test was modified to simulate harsh environments. The coated panels were cycled for noted time periods by subjecting them to 100 percent humidity followed by a two hour exposure to freezing temperatures at −28.9° C. (−20° F.). The chip performance was rated on a scale of 0 to 10, 10 representing the initial untested panel and 0 representing total (100 percent) removal of the coating from the substrate surface. A reading of 6 and above was considered acceptable.

Adhesion

The adhesion of the top layer over the intermediate layer after a noted delay was measured under ASTM D3359-95 Adhesion Test. The adhesion performance was rated on a scale of 0 to 10, 10 representing the initial untested panel and 0 representing total (100 percent) removal of the coating from the coated surface. A reading of 7 and above was considered acceptable.

Humidity

The adhesion of the durable layer to the difficult-to-coat substrate was tested under ASTM D2247-94 Humidity test for noted time periods. The adhesion of the coatings was then tested under ASTM D3359-95 Adhesion Test.

The following examples illustrates the invention.

EXAMPLES

Polyester Primer

A polyester primer included in the flexible primer was produced in view of the teachings in Example 1 in the U.S. Pat. No. 4,442,269, except 22.5 moles of azelaic acid use in producing the Branched Oligoester 1 of Example 1 was replaced with a mixture of 11.5 moles of adipic acid and 11.5 moles of 1,12 dodecanoic diacid.

Flexible Primer

The components of Table 1 below were added to the polyester primer described above (all in weight percent):

TABLE 1

| | |
|---|---|
| Flexible Polyester | 20.5 |
| Extender pigment[1] | 21.6 |
| White pigment[2] | 43.1 |
| Black pigment[3] | 1.0 |
| Solvent (acetone) | 5.1 |
| Anti-settling agent[4] | 2.0 |
| Flow additive[5] | 0.75 |
| UV screener[6] | 0.3 |
| Solvent (methyl amyl ketone) | 3.1 |
| Catalyst (di-butyl tin dilaurate in 2% ethyl acetate) | 0.5 |
| Solvent (ethyl hexyl acetate) | 1.9 |
| Total | 100.5 |

[1]Mixture of W-12 Barium Sulfate, W-1004 Calcium Carbonate and W-1002 Aluminum Silicate, all supplied by Chem Central of Pittsburgh, Pennsylvania.
[2]TiPure ®titanium dioxide supplied by DuPont Company of Wilmington, Delaware.
[3]Furnace carbon black powder supplied by Cabot Company of Boston, Massachusetts.
[4]Benton 38 dispersion in ketone at 8% solids supplied by Rheox, Inc. of Hightstown, New Jersey.
[5]ResifloS acrylic terpolymer in 50% aromatic solvent supplied by Chem Central of Pittsburgh, Pennsylvania.
[6]Tinuvin ®292 UV Light Stabilizer supplied by Ciba Specialties of New Milford, Connecticut.

All the coatings, unless specified otherwise, are noted as dry film thickness.

Comparative Example

The control aluminum panel used for applying a conventional multi-layered system (Comparative Example) was cleaned by using 3812S Fast-Dry reducer supplied by DuPont Company, Wilmington, Del. for removing dust, greases, oils or fingerprints. The cleaned panel was then sanded for about 10 minutes with 180 grit sand followed by second cleaning with 3812S Fast-Dry reducer.

The sanded and cleaned panel was etched with 615S Variprime® self-etching primer supplied by DuPont Company, Wilmington, Del. A coating of 12.7 microns (0.5 mil) thickness was flash dried under ambient conditions for 30 minutes.

The etched panel was then coated with 934S Corlar® epoxy primer supplied by DuPont Company, Wilmington, Del. The epoxy primer was activated at 5:1 volumetric ratio with a modified 936S Corlar® ketimine activator, supplied by DuPont Company, Wilmington, Del. The activator was diluted to 30 percent by weight with acetone. A coating of 38 microns (1.5 mil) thickness was baked for 30 minutes at 82.2° C. (180° F.). The application of the foregoing primer is necessary to prevent rust damage on etched aluminum surfaces.

The primed control panel was then coated to a thickness of 51 microns (2 mil) with Imron® 6000 polyurethane white enamel supplied by DuPont Company, Wilmington, Del., which was activated at a volumetric ratio of 3:1 with Imron® 193S diisocyanate activator (@ 75% solids) supplied by DuPont Company, Wilmington, Del. The coating was flash dried under ambient conditions for 15 minutes.

The coated control panel was then coated to a thickness of 51 microns (2 mil) with top clear coat of Imron® 3440S polyurethane enamel (hydroxyl containing acrylic-urethane copolymer @ 53.4% solids) supplied by DuPont Company, Wilmington, Del., which was activated at a volumetric ratio of 3:1 with Imron® 193S diisocyanate activator (@ 75% solids) mixed with 389 S Imron® 5000 Fast-Dry Accelerator at 2 percent by volume, both supplied by DuPont Company, Wilmington, Del. The clear coating was baked for 30 minutes at 82.2° C. (180° F.).

Two sets of control panels were simultaneously prepared for adhesion test under humidity and cycled chip performance test.

Example 1

The aluminum panel used for applying a multi-layered system of the present invention was cleaned by using 3812S Fast-Dry reducer supplied by DuPont Company, Wilmington, Del. for removing dust, greases, oils or fingerprints. The cleaned panel was then subjected to adhesion promoting step. The surface was coated with METALOK® 230S supplied by DuPont Company, Wilmington, Del. The excess of coating was drained from the surface and then the adhesion promoted surface was air dried.

The adhesion promoted panel was then coated within 15 minutes to a 38 microns (1.5 mil) thickness with the flexible primer composition of Table 1 activated at 4:1 volumetric ratio with Imron® 193S diisocyanate activator (@ 75% solids) mixed with 389 S Imron® 5000 Fast-Dry Accelerator at 2 percent by volume, both supplied by DuPont Company, Wilmington, Del. The coating was flash dried under ambient conditions for one hour. This was the intermediate layer.

The coated panel was then coated to a thickness of 51 microns (2 mil) with top clear coat of Imron® 3440S polyurethane enamel (hydroxyl containing acrylic-urethane copolymer @ 53.4% solids) supplied by DuPont Company, Wilmington, Del., which was activated at a volumetric ratio of 3:1 with Imron® 193S diisocyanate activator (@ 75% solids) mixed with 389 S Imron® 5000 Fast-Dry Accelerator at 2 percent by volume, both supplied by DuPont Company, Wilmington, Del. The clear coating was baked for 30 minutes at 82.2° C. (180° F.). This was the mar resistant top layer.

Two sets of panels coated with multi-layered coating of the present invention were simultaneously prepared for adhesion test under humidity and cycled chip performance test.

The comparative panel and panel of Example 1 were each tested for adhesion after exposure for 96 and 240 hours to humidity under ASTM D2247-94 Humidity Test. The results shown in Table 2 below:

TABLE 2

| Hours of Humidity Exposure | Comparative Panel Adhesion | Panel of Example 1 Adhesion |
|---|---|---|
| 0 | 5* | 10 |
| 96 | 6** | 9 |
| 240 | 0*** | 9 |

*Adhesion loss due splitting of primer coat.
**Adhesion loss due splitting of primer coat (slight improvement may have occurred initially due interaction of isocyanate with moisture).
***Adhesion loss down to bare substrate.

From Table 2, it is apparent that humidity exposure has negative affects on the comparative panel, however even a significant exposure of the Example 1 panel to humidity effectively had an insignificant impact on the adhesion of the coating compositions described in Example 1.

Second set of panels were exposed to cycled chip resistance in the following fashion. The panels were initially exposed to Gravelometer Test, then again repeatedly exposed to the Gravelometer test after cyclic exposure to 100 percent humidity followed by freezing for 2 hours at −28.9° C. (−20° F.). The Gravelometer test was conducted after 96 hours, 240 hours, 500 hours, 750 hours, 1000 hours and 1500 hours intervals of humidity, each interval being interspersed by freezing for 2 hours at −28.9° C. (−20° F.). Upon the completion of the test, the comparative panel had a reading of 0 (all the coating was removed from the panel). By contrast, the coated panel of Example 1 had a reading of 8, thus indicating unexpectedly high performance. From these results, it is readily apparent that the coated panel of the present invention was not only substantially more durable, but it was also produced by using significantly fewer process steps, such as sanding and priming, which are typically used in the conventional coating processes.

Another unexpectedly significant advantage of the present invention is that it allows the user to delay the application of the mar resistant top layer for significant periods of up to 12 weeks, without requiring a time consuming sanding and cleaning steps. Series of panels were coated with the intermediate layer using the steps described in Example 1, followed after a noted delays, by coating with the mar resistant top player using the steps described in Example 1. The coated panels were adhesion tested under ASTM D3359-95 thereafter and after exposure to humidity for specified intervals. The results are shown in Table 3 below:

TABLE 3

| Recoat Interval | Initial Adhesion | Adhesion after 96 hour humidity exposure | Adhesion after 240 hour humidity exposure |
|---|---|---|---|
| 1 hour | 10 | 10 | 10 |
| 1 day | 10 | 10 | 10 |
| 1 week | 10 | 10 | 10 |
| 2 weeks | 10 | 10 | 10 |
| 3 weeks | 10 | 10 | 10 |
| 4 weeks | 10 | 10 | 10 |
| 6 weeks | 10 | 8/10* | 10 |

*Adhesion test was performed at different locations

From the results shown in Table 3, it is apparent that even a significant delay in the application of recoat (the mar resistant top layer) on the intermediate layer, has insignificant impact on the adhesion of the mar resistant top layer to the intermediate layer. This result was unexpected, since conventionally clear coats require a time consuming sanding step followed by cleaning step, if the application of the top layer is delayed by more than 36 hours.

What is claimed is:

1. A process for producing a durable coating on a difficult-to-coat substrate made of aluminum or steel, said process comprising:

subjecting the surface of said difficult-to-coat substrate to an adhesion promoting treatment, which comprises:

cleaning said surface of said difficult-to-coat substrate, applying a film of a silane adhesion promoter on said clean surface of said substrate, said film having a dry thickness in the range of from 100 Å to 2500 Å, said adhesion promoter comprising:

a solution of one or more silanes having the following formula:

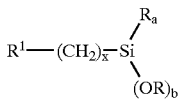

wherein x is an integer between 1 and 3, R is the same or different alkyl having 1 to 3 carbons, a is 0 or an integer between 1 and 3, b equals 3-a, and $R^1$ is selected from the group consisting of:

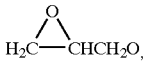

$H_2N$, $H_2N(CH_2)_2NH$, $H_2N(CH_2)_2NH(CH_2)_2NH$, and $H_2N[(CH_2)_2NH]_z$ wherein z is 0 or an integer of 1 to 3; said silane being present in a concentration in the range of 0.001 to 10.0 percent by weight of the solution, removing any excess amount of said silane adhesion promoter from said surface; and drying said surface having said film of said silane adhesion promoter thereon;

applying an intermediate layer of a flexible primer on said adhesion promoted surface of said difficult-to-coat substrate, said flexible primer consisting essentially of:

a polyester copolymer and a crosslinker, said polyester copolymer being produced through a two-stage polymerization process, said polyester copolymer having a linear segment with terminal hydroxyl groups and a GPC number average molecular weight (Mn) in the range of from 500 to 3000, and a branched segment with lateral hydroxyl groups and a GPC number average molecular weight (Mn) in the range of from 750 to 1500;

applying a mar resistant top layer of a clear coating composition on said intermediate layer to produce said durable coating on said difficult-to-coat substrate, said clear coating composition comprising:

a polyisocyanate binder, fluorinated polyisocyanate binder, an acrylic fluorocarbon binder or a combination thereof.

2. The process of claim 1 wherein said flexible primer is pigmented.

3. The process of claim 1 or further comprising applying one or more patterned layers on said intermediate layer, each said patterned layer containing a pigment of a different color.

4. The process of claim 1 wherein said step of removing said excess amount of said silane adhesion promoter comprises finishing with water or aqueous organic solvent, wiping with a water-wet material or blowing with air.

5. The process of claim 1 wherein said fluorinated polyisocyanate binder comprises:

a fluorinated polyisocyanate, which is a reaction product of an organic polyisocyanate and a fluorinated monofunctional alcohol represented by the formula:

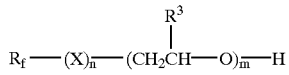

where $R_f$ is a fluoroalkyl containing group having at least 4 carbon atoms, X is a divalent radical, $R^3$ is H or an alkyl group having in the range of from 1 to 4 carbon atoms, n is 0 or 1 and m is in the range of from 0 to 30 provided that when n is 0 then m must be equal to or greater than 1 and when m is 0 then n is 1; wherein in the range of from 0.1 to 33 mole percent of active isocyanate groups are reacted with the fluorinated monofunctional alcohol; and a film forming polymer.

6. The process of claim 5 wherein said film forming polymer is selected from the group consisting of an acrylic polymer, a polyester, an alkyd resin, a polyol and a combination thereof.

7. The process of claim 1 wherein said acrylic fluorocarbon binder comprises:

an acrylic polymer polymerized from a monomer mix comprising one or more hydroxyl containing monomers and one or more fluoroalkyl containing monomer represented by the formula:

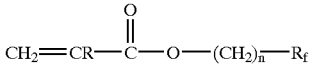

where R is hydrogen or an alkyl group having 1 or 2 carbon atoms, n is an integer in the range of from of 1 to 11 and $R_f$ is a fluoroalkyl containing group having at least 4 carbon atoms, said acrylic polymer having a weight average molecular weight in the range of from 2,000 to 20,000; and an organic polyisocyanate crosslinking agent, wherein said top layer in its cured state has a combination of a water advancing contact angle of at least 100° and a hexadecane advancing contact angle of at least 40°.

8. The process of claim 2 further comprising applying one or more patterned layers on said intermediate layer, each said patterned layer containing a pigment of a different color.

9. The process of claim 1 wherein said mar resistant top layer is applied after a delay of 1 week to 12 weeks.

10. The process of claim 3 or 8 wherein said one or more patterned layers are applied after a delay of 1 week to 12 weeks.

11. The process of claim 1, 2 or 8 wherein said mar resistant top layer is applied after a delay of 1 week to 12 weeks.

12. The process of claim 10 wherein said mar resistant top layer is applied after a delay of 1 week to 12 weeks.

13. A difficult-to-coat substrate coated with a durable coating produced in accordance with the process of claim 1.

14. A process for producing a durable coating on a difficult-to-coat substrate made of aluminum or steel, said process comprising:

subjecting the surface of said difficult-to-coat substrate to an adhesion promoting treatment, which comprises:

cleaning said surface of said difficult-to-coat substrate, applying a film of a silane adhesion promoter on said clean, surface of said substrate, said film having a dry thickness in the range of from 100 Å to 2500 Å, said adhesion promoter comprising;

a solution of one or more silanes having the following formula:

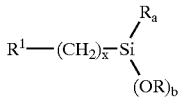

wherein x is an integer between 1 and 3, R is the same or different alkyl having 1 to 3 carbons, a is 0 or an integer between 1 and 3, b equals 3-a, and $R^1$ is selected from the group consisting of:

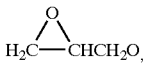

$H_2N$, $H_2N(CH_2)_2NH$, $H_2N(CH_2)_2NH(CH_2)_2NH$, and $H_2N[(CH_2)_2NH]_z$ wherein z is 0 or an integer of 1 to 3; said silane being present in a concentration in the range of 0.001 to 10.0 percent by weight of the solution, removing any excess amount of said silane adhesion promoter from said surface; and drying said surface having said firm of said silane adhesion promoter thereon;

applying an intermediate layer of a flexible primer on said adhesion promoted surface of said difficult-to-coat substrate, said flexible primer consisting essentially of;

a polyester copolymer and a crosslinker, said polyester copolymer being produced through a two-stage polymerization process, said polyester copolymer having a linear segment with terminal hydroxyl groups and a GPC number average molecular weight (Mn) in the range of from 500 to 3000, and a branched segment with lateral hydroxyl groups and a GPC number average molecular weight (Mn) in the range of from 750 to 1500;

applying a mar resistant top layer of a clear coating composition on said intermediate layer after a delay of one week to twelve weeks to produce said durable coating on said difficult-to-coat substrate, said clear coating composition comprising:

a polyisocyanate binder, fluorinated polyisocyanate binder, an acrylic fluorocarbon binder or a combination thereof.

* * * * *